343-909 SR
6/20/78 XR 4,096,483

United States Patent [19]
Bui Hai et al.
[11] 4,096,483
[45] Jun. 20, 1978

[54] REFLECTOR WITH FREQUENCY SELECTIVE RING OF ABSORPTIVE MATERIAL FOR APERTURE CONTROL

[75] Inventors: Nhu Bui Hai; Philippe Magne, both of Paris, France

[73] Assignee: Thomson-CSF, Paris, France

[21] Appl. No.: 665,445

[22] Filed: Mar. 9, 1976

[30] Foreign Application Priority Data

Mar. 14, 1975 France ..... 75 08072

[51] Int. Cl.[2] ..... H01Q 9/12
[52] U.S. Cl. ..... 343/781 CA; 343/909
[58] Field of Search ..... 343/754, 781 CA, 909, 343/18 A, 755, 782, 840

[56] References Cited

U.S. PATENT DOCUMENTS

| | | | |
|---|---|---|---|
| 2,460,869 | 2/1949 | Braden | 343/840 |
| 3,101,473 | 8/1963 | Fenlon | 343/840 |
| 3,156,917 | 11/1964 | Parmeggiani | 343/18 A |
| 3,314,071 | 4/1967 | Lader et al. | 343/840 |
| 3,430,245 | 2/1969 | Wolcott | 343/909 |
| 3,594,804 | 7/1971 | Hersch et al. | 343/781 CA |
| 3,938,152 | 2/1976 | Grimes et al. | 343/18 A |

*Primary Examiner*—Eli Lieberman
*Attorney, Agent, or Firm*—Cushman, Darby & Cushman

[57] ABSTRACT

An antenna is made operative for two frequency bands, $\Delta F_B$ and $\Delta F_H$, the latter higher than the former, by means of a frequency selective absorber, covering, in its edge region, a reflector of the antenna in order to reduce the diameter of the reflecting surface of the reflector and therefore the gain of the antenna for frequency band $\Delta F_H$.

2 Claims, 5 Drawing Figures

REFLECTOR WITH FREQUENCY SELECTIVE RING OF ABSORPTIVE MATERIAL FOR APERTURE CONTROL

This invention relates to antennae comprising radiating reflectors or lenses, in which problems of gain arise for certain frequency bands.

It is known that, in such antennae comprising radiating reflectors or lenses, gain increases with the operational frequency and, correlatively, the antenna aperture angle decreases when the operational frequency increases. Thus, in the case of a parabolic reflector illuminated at its centre for example, gain is a function of the square of the operational frequency.

It follows from this increase in gain and this decrease in the aperture angle that an antenna which was designed for one or more given frequency bands can no longer be used beyond a certain frequency value, firstly because its radiated power is too great in relation to what is accepted under the CCIR standards and secondly because its aperture angle is so fine that the least vibration or the least torsion of the antenna support under the effect of wind would result in misalignment of the antenna.

Accordingly, this variation in gain as a function of frequency limits the number of frequency bands in which a given antenna may be used and results in separate antennae being used when the operational frequency bands lead to deviations in gain which are not compatible with the requirements to be satisfied by a correct hertzian link. This solution, which consists in using separate antennae, is of course onerous.

The object of the present invention is to provide antennae which are able to operate satisfactorily within a wide frequency range taking advantage of the fact that frequency selective absorbers are known which are used for entirely covering the active surface of an antenna reflector, so as to prevent a receiver fed by the considered antenna from receiving waves in an undesired frequency band, the latter being entirely absorbed by the absorber.

In this description, reference is made to radiating elements of the optical type to designate reflectors and lenses, including those lenses which are formed by means of active elements supported by a passive radome. Both in the description and in the claims reference is made to active surface which, in the case of a reflector, means its reflecting surface and, in the case of a lens, either of its two surfaces which participate in the transmission of electromagnetic waves.

According to the invention, there is provided an antenna for working in two frequency bands, $\Delta F_B$ and $\Delta F_H$ (with $\Delta F_H$ higher than $\Delta F_B$) and; comprising n (n : positive integer) radiating elements having respective active surfaces, an active surface of at least one of said elements being in part covered by a strip of frequency selective absorber having two faces and two edges, one of said two edges following the periphery of the active surface which said strip partially covers and one of said two faces being totally in contact with the active surface which said strip partially covers, said frequency selective absorber imparting an important attenuation in the band $\Delta F_H$ and an attenuation which is substantially zero in the band $\Delta F_B$.

Other features will become apparent and the invention will be better understood from a consideration of the ensuing description and the accompanying drawing in which.

Figure 1:
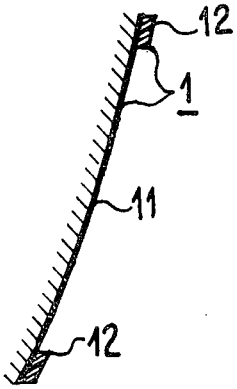
FIGS. 1 and 2 are two different views of a reflector of an antenna according to the invention.
Figure 2:
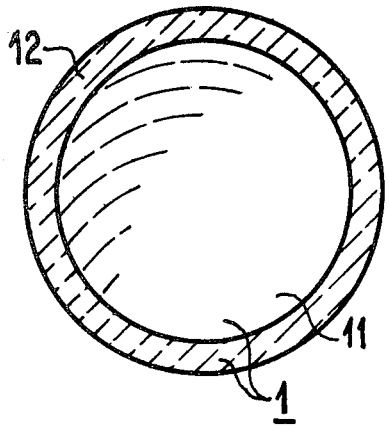

FIGS. 1 and 2 are, respectively, a section through and a front view of a reflector of an antenna according to the invention. In addition to a reflecting metal plate, 11, this reflector, 1, comprises a ring, 12, made of a material which acts as a frequency selective absorber. The reflecting metal plate is part of a hyperboloid. It is its convex surface which is used as the reflecting surface. The absorber is in the form of a strip of substantially constant width and thickness which is joined at its ends to form the ring 12. This ring is of such dimensions and is bonded to the convex surface of the metal plate 11 in such a way that its outer contour follows the outer contour of the metal plate.

Figure 3:
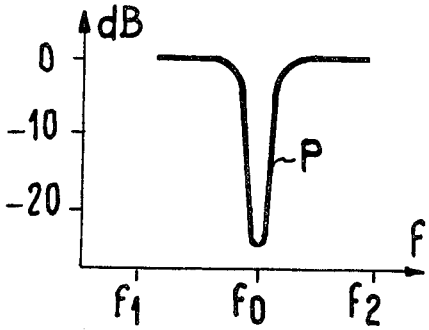
FIG. 3 is a curve representing one of the characteristics of a material used in the reflector of FIGS. 1 and 2.

FIG. 3 explains the absorbing function performed by the ring 12 illustrated in FIGS. 1 and 2. In Cartesian co-ordinates, this drawing gives the attenuation characteristic in decibels as a function of the frequency for the absorber used. The curve P, representative of this characteristic, shows that the absorber heavily attenuates (to more than 20 dB) in a narrow frequency band centred around a frequency $f_o$, and that the attenuation is substantially zero for frequencies $f_1$ and $f_2$ remote from $f_o$.

Thus the selective absorber, at the frequencies where it absorbs, reduces the diameter of the reflecting surface of the reflector 1 and consequently the gain of the antenna.

The type of absorber used is selected in dependence upon a predetermined frequency band $\Delta f_H$ inside which the attenuation must have at least a certain predetermined value. It is obvious that this predetermined frequency band may be such that its central frequency does not correspond to the frequency $f_o$ of the maximum attenuation. Such a shift of the centre of the band $\Delta f_H$ relative to the frequency for which the absorber imparts maximum attenuation, is necessary, for example, in the case where the attenuation in a band $\Delta f_B$ below but close to the band $\Delta f_H$ must be substantially zero and not only of the order of 1 to 2 dB. In this case, the frequency $f_o$ (cf. FIG. 3) is made slightly higher than the central frequency of the band $\Delta f_H$ so that attenuation is substantially zero in the band $\Delta f_B$ while remaining at least equal to the predetermined value in the band $\Delta f_H$.

Figure 4:
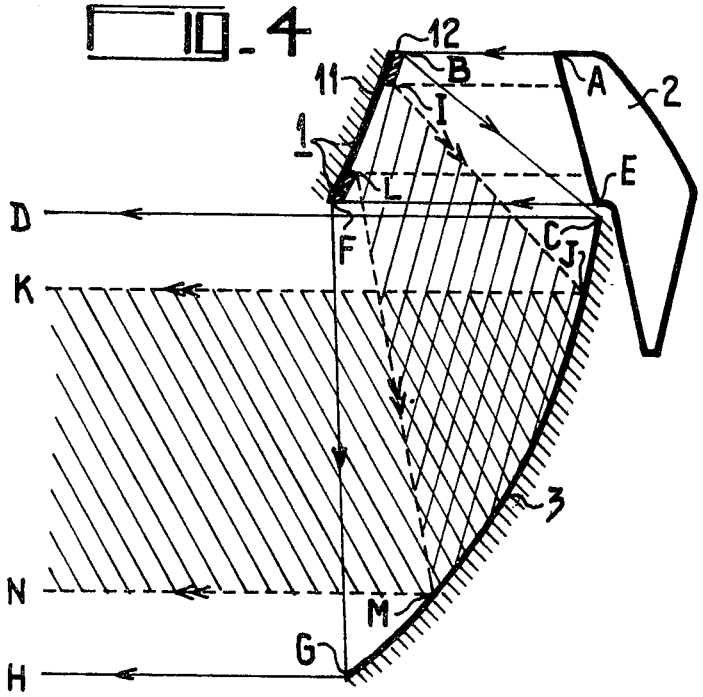
FIG. 4 shows an antenna according to the invention.

FIG. 4 shows one embodiment illustrating the operating principle of the reflector 1 shown in FIGS. 1 and 2.

FIG. 4 shows an antenna of the Cassegrain type with its primary source 2 of the reflecting horn type, its auxiliary reflector 1 shown in section and already described with reference to FIGS. 1 to 3 and its main parabolic reflector 3, which is also shown in section. This antenna has an aperture diameter of 4 meters. In the interest of clarity, the elements which lead to the primary source 2 and which are intended to supply it with energy to be radiated have not been shown in the drawing.

The antenna shown in FIG. 4 is a multiband antenna working in two frequency ranges:

$$\Delta f_B = 3.6 \text{ to } 7.11 \text{ KMc}$$

$\Delta f_H$ = 10.7 to 11.7 KMc

Before introduction of the absorbing ring 12, this antenna had only been designed for the band from 3.6 to 7.11 KMc. The wave issuing from the primary source, irrespective of its frequency, would thus have followed a path of which the outline in the plan shown in FIG. 4 is denoted by the straight line sections:

AB and EF between the primary source 2 and the auxiliary reflector 1,

BC and FG between the auxiliary reflector 1 and the main reflector 3,

CD and GH at the output of the main reflector 3.

The antenna shown in FIG. 4, used without an absorber, has a gain of 50 dB at 11 KMc and an aperture at - 3 dB of ± 0°.12. These characteristics are surplus to requirements for use in normal hertzian beams.

The use of the absorbing ring 12 enables these disadvantages to be overcome. The absorber selected for this ring (for example ECOSORB SF 14 manufactured by EMERSON & CUMING) is a material which, for a thickness of 1.1mm, produces an attenuation of 20 dB at 14 KMc, 8 dB at 11 KMc and substantially 0 dB at 7 KMc. The average width of the ring 12 is equal to 130 mm. In the band from 10.7 to 11.7 KMc, this ring results in a reduction of the width of the path followed by the wave emanating from the primary source 2 immediately after its reflection by the auxiliary reflector 1. In the plan of FIG. 4, this path of reduced width is hatched and its outlines are represented by the straight line sections:

IJ instead of BC,

JK instead of CD,

LM instead of FG, and

MN instead of GH.

The aperture diameter of the antenna thus changes from 4 m to 3 m. This results in a fall in the gain of the antenna which changes from 50 to 48.5 dB and in an increase in the beam angle of the antenna which changes from ± 0°.12 to ± 0°.16.

Other embodiments of reflector-equipped antennae, of which at least one of the reflectors would be partially covered with a selective frequency absorber, may of course be envisaged without departing from the scope of the invention. Thus, in FIG. 4, the absorbing ring could be arranged on the main reflector 3 or even on the reflecting surface inside the horn 2 instead of being arranged on the auxiliary reflector 1. Similarly, the absorber may be selected for example not to reduce gain in the highest of the operational frequency bands of the antenna, but to reduce gain in another of its operational frequency bands. So far as the antenna is concerned, it may be of a different type from the antenna shown in FIG. 4 which is a decentred Cassegrain antenna. In most cases, although not necessarily, the antenna according to the invention will be an antenna comprising an output reflector which, as shown in the Cassegrain antenna, would be a centred or decentred parabolic reflector illuminated by a real or virtual source positioned at its centre.

Figure 5:
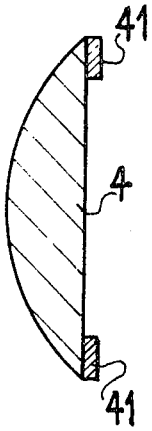
FIG. 5 is a view of a lens of an antenna according to the invention.

It is also possible to produce antennae according to the invention in which at least one of the radiating elements is a lens and in which the absorber partially covers one of the two surfaces of the lens. FIG. 5 is a section through a lens 4, of such an antenna. The lens 4 is a convergent lens and one of its two faces is a plane one. On the plane face of lens 4 to a ring 41 is stuck, which is made of a material which is a frequency selective absorber; this ring has a contour which follows the edge of the lens.

Of course, the invention is not limited to the embodiments described and shown which were given solely by way of example.

What is claimed is:

1. An antenna for working in two frequency bands, $\Delta F_B$ and $\Delta F_H$ (with $\Delta F_H$ higher than $\Delta F_B$) and comprising $n$ ($n$ : positive integer) radiating elements having respective active surfaces, an active surface of at least one of said elements being in part covered by a strip of frequency selective absorber having two faces and two edges, one of said two edges following the periphery of the active surface which said strip partially covers and one of said two faces being totally in contact with the active surface which said strip partially covers, said frequency selective absorber imparting an important attenuation in the band $\Delta F_H$ and an attenuation which is substantially zero in the band $\Delta F_B$.

2. An antenna of the Cassegrain type having an auxiliary reflector as claimed in claim 1, wherein said active surface which is covered by said absorber is that of its auxiliary reflector.

* * * * *